US009146570B2

(12) United States Patent
Rentala et al.

(10) Patent No.: US 9,146,570 B2
(45) Date of Patent: Sep. 29, 2015

(54) LOAD CURRENT COMPESATING OUTPUT BUFFER FEEDBACK, PASS, AND SENSE CIRCUITS

(75) Inventors: Vijaya Bhaskar Rentala, Plano, TX (US); Swaminathan Sankaran, Plano, TX (US); Venkatesh Srinivasan, Dallas, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 1128 days.

(21) Appl. No.: 13/085,490

(22) Filed: Apr. 13, 2011

(65) Prior Publication Data

US 2012/0262138 A1 Oct. 18, 2012

(51) Int. Cl.
*G05F 1/20* (2006.01)
*G05F 1/575* (2006.01)

(52) U.S. Cl.
CPC ..... *G05F 1/575* (2013.01)

(58) Field of Classification Search
USPC ..... 323/275–281, 312, 314–317
See application file for complete search history.

(56) References Cited

U.S. PATENT DOCUMENTS 6,246,221 B1 * 6/2001 Xi ..... 323/280
6,600,299 B2 * 7/2003 Xi ..... 323/280
6,806,690 B2 * 10/2004 Xi ..... 323/273
6,977,490 B1 * 12/2005 Zhang et al. ..... 323/280
7,166,991 B2 * 1/2007 Eberlein ..... 323/280
7,375,992 B2 * 5/2008 Mok et al. ..... 363/60
7,405,546 B2 * 7/2008 Amrani et al. ..... 323/273
7,432,693 B2 * 10/2008 Enjalbert ..... 323/280
7,446,515 B2 * 11/2008 Wang ..... 323/280
7,830,129 B2 * 11/2010 Tseng ..... 323/281
8,169,203 B1 * 5/2012 Vemula ..... 323/273
2012/0038332 A1 * 2/2012 Lin ..... 323/277

* cited by examiner

*Primary Examiner* — Adolf Berhane
*Assistant Examiner* — Nusrat Quddus
(74) *Attorney, Agent, or Firm* — Lawrence J. Bassuk; Charles A. Brill; Frank D. Cimino

(57) ABSTRACT

A load current compensating output buffer circuit and method are disclosed. The circuit includes a buffer amplifier coupled to a supply voltage and the inverting input receives an input voltage and the non-inverting input couples to an output capacitive load. A feedback impedance with a variable resistance circuit and a Miller capacitance in series is coupled to an output of the buffer amplifier and the capacitive load. A pass transistor couples to the supply voltage and the output capacitive load, the pass transistor having a gate terminal coupled to the output of the output buffer amplifier and the feedback impedance, a load current passing through the pass transistor. A sense circuit is configured to sense the load current and apply a control voltage to the variable resistance circuit to vary the resistance of the variable resistance circuit based on the load current.

8 Claims, 6 Drawing Sheets

LOAD CURRENT COMPESATING OUTPUT BUFFER FEEDBACK, PASS, AND SENSE CIRCUITS

TECHNICAL FIELD

Embodiments of the disclosure generally relate to the field of electronics, and more particularly to output buffer compensation circuit and method.

BACKGROUND

Output buffers are widely used in analog circuits to drive large external capacitive loads. One typical application for an output buffer is with a low drop-out (LDO) voltage regulator. The LDO voltage regulator is coupled to a capacitive load through an output buffer. A capacitive load may be a battery. The output buffer load current bandwidth and stability limits the overall LDO voltage regulator settling and power up time. For example, in a LDO voltage regulator, the load current may vary from no load current (0 mA) to about 300 mA. This leads to an approximate 300 times increase in the load current bandwidth, making the output buffer unstable due to high frequency poles.

It will be desirable to have output buffers configured to operate efficiently for various load conditions.

SUMMARY

This summary is provided to comply with 37 C.F.R. §1.73, requiring a summary of the invention briefly indicating the nature and substance of the invention. It is submitted with the understanding that it will not be used to interpret or limit the scope or meaning of the claims.

A load current compensating output buffer circuit and method are disclosed. In one aspect, load current compensating output buffer circuit is disclosed. The output buffer circuit includes an output buffer amplifier with a terminal for coupling to a supply voltage and having an inverting input and a non-inverting input, wherein the inverting input is configured to receive an input voltage and the non-inverting input is coupled to an output capacitive load. A feedback impedance is coupled to an output of the output buffer amplifier and to the output capacitive load, wherein the feedback impedance comprises a variable resistance circuit and a Miller capacitance coupled in series. A pass transistor is configured to couple to the supply voltage and the output capacitive load, the pass transistor having a gate terminal coupled to the output of the output buffer amplifier and the feedback impedance, a load current passing through the pass transistor. A sense circuit is configured to sense the load current and apply a control voltage to the variable resistance circuit to vary the resistance of the variable resistance circuit based on the load current.

In another aspect, a system with load current compensating output buffer circuit is disclosed. The system includes an output buffer amplifier with a terminal for coupling to a supply voltage and having an inverting input and a non-inverting input, wherein the inverting input can receive an input voltage and the non-inverting input is coupled to an output capacitive load. A pass transistor couples the supply voltage and the output capacitive load. The pass transistor has a gate terminal that is coupled to the output of the output buffer amplifier. A load current passes through the pass transistor. A first sense transistor is coupled to the supply voltage and a servo loop. The first sense transistor has a gate terminal coupled to the output of the output buffer amplifier, and is configured to measure the load current as a sense current. A servo loop is coupled to the output buffer amplifier. The servo loop is configured to compensate the gain of the output buffer amplifier in response to the sensed load current of the output buffer circuit.

In yet another aspect, a low dropout linear voltage regulator is disclosed. The linear voltage regulator includes an error amplifier for coupling to a supply voltage and has an inverting input and a non-inverting input. The inverting input is coupled to a first and a second resistor and the non-inverting input is configured to receive a reference voltage. A load current compensating output buffer circuit is coupled to the output of the error amplifier and a first capacitor. The output buffer circuit includes: an output buffer amplifier for coupling to a supply voltage and having an inverting input and a non-inverting input, wherein the non-inverting input is coupled to the output of the error amplifier and the first capacitor and the inverting input is coupled to an output capacitive load. A feedback impedance is coupled to an output of the output buffer amplifier and to the output capacitive load, wherein the feedback impedance comprises a variable resistance circuit and a Miller capacitance coupled in series. A pass transistor is configured to couple to the supply voltage and the output capacitive load, the pass transistor having a gate terminal coupled to the output of the output buffer amplifier and the feedback impedance, a load current passing through the pass transistor. A sense circuit is configured to sense the load current and apply a control voltage to the variable resistance circuit to vary the resistance of the variable resistance circuit based on the sensed load current.

In yet another aspect, a method for load compensating in an output buffer circuit is disclosed. The method includes: Providing an output buffer amplifier coupled to a supply voltage, with an inverting input configured to receive an input voltage and a non-inverting input coupled to an output capacitive load; Coupling a feedback impedance with a variable resistance circuit and a Miller capacitance coupled in series, to an output of the output buffer amplifier and to the output capacitive load; Coupling a pass transistor to the supply voltage and the output capacitive load, a load current passing through the pass transistor; and Sensing the load current and applying a control voltage to the variable resistance circuit based on the sensed load current.

In yet another aspect, a method for load compensating in an output buffer circuit is disclosed. The method includes: Providing an output buffer amplifier coupled to a supply voltage, with an inverting input configured to receive an input voltage and a non-inverting input coupled to an output capacitive load; Coupling a feedback impedance with a variable resistance circuit and a Miller capacitance coupled in series, to an output of the output buffer amplifier and to the output capacitive load; Coupling a pass transistor to the supply voltage and the output capacitive load, a load current passing through the pass transistor; and Sensing the load current and applying a control voltage to the variable resistance circuit based on the sensed load current.

Other features of the embodiments will be apparent from the accompanying drawings and from the detailed description that follows.

BRIEF DESCRIPTION OF THE VIEWS OF DRAWINGS

DETAILED DESCRIPTION

Figure 1:
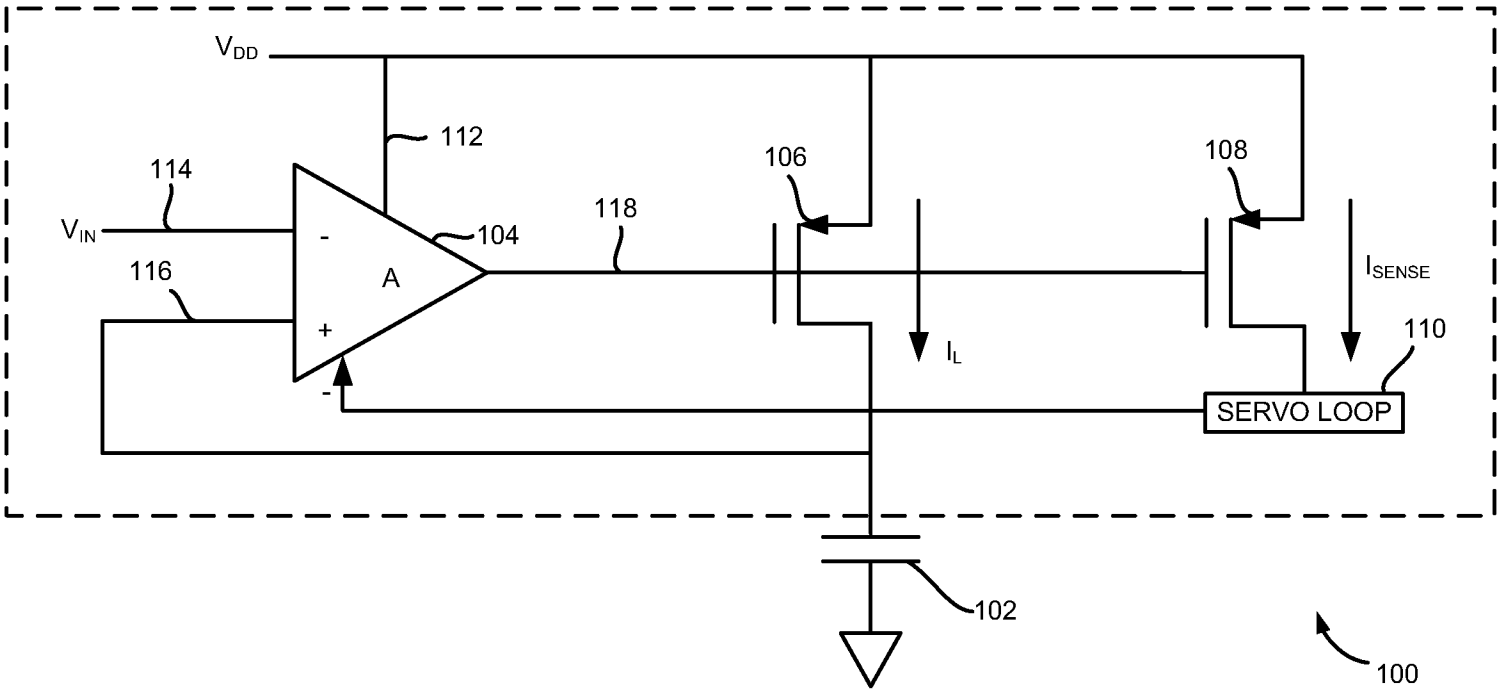
FIG. 1 illustrates a block diagram of an output buffer with a load current dependent compensation circuit, according to one embodiment.

A load current compensating output buffer circuit and a method for load current compensating a buffer circuit are disclosed. The following description is merely exemplary in nature and is not intended to limit the present disclosure, applications, or uses. It should be understood that throughout the drawings, corresponding reference numerals indicate like or corresponding parts and features.

FIG. 1 illustrates a block diagram of an output buffer 100 with a load current dependent compensation circuit coupled to a capacitive load 102, according to one embodiment. The output buffer 100 includes an output buffer amplifier 104, a pass transistor 106, a first sense transistor 108 and a servo loop circuit 110.

The output buffer amplifier 104 includes a terminal 112 for coupling to supply voltage $V_{DD}$, an inverting input 114, a non-inverting input 116 and an output terminal 118. The inverting input 114 is configured to receive an input voltage $V_{IN}$. The non-inverting input 116 is coupled to the capacitive load 102.

The pass transistor 106 is configured to couple to the supply voltage $V_{DD}$ and the capacitive load 102. In one embodiment, the pass transistor 106 is a PMOS transistor with a source, drain and gate terminals. The source terminal of the pass transistor 106 is coupled to the supply voltage VDD, the drain terminal of the pass transistor 106 is coupled to the capacitive load 102 and the gate terminal of the pass transistor 106 is coupled to the output terminal 118 of the output buffer amplifier 104. A load current IL passes through the pass transistor 106 to the capacitive load 102.

The first sense transistor 108 is configured to couple to the supply voltage and the servo loop circuit 110. In one embodiment, the first sense transistor 108 is a PMOS transistor with a source, drain and gate terminals. The source terminal of the first sense transistor 108 is coupled to the supply voltage VDD, the drain terminal of the first sense transistor 108 is coupled to the servo loop circuit 110 and the gate terminal of the first sense transistor 108 is coupled to the output terminal 118 of the output buffer amplifier 104. A sense current Isense passes through the first sense transistor 108 and fed to the servo loop circuit.

The servo loop circuit 110 is configured to sense the load current flowing to the capacitive load 102 and adjust the loop gain of the output buffer amplifier 104 based on the load current flowing to the capacitive load 102. During no load conditions, the output buffer circuit 100 is stabilized by the capacitive load 102 and the output buffer circuit 100 is designed to have the necessary bandwidth for the load current during the no load condition. As the output buffer circuit 100 transitions from a no load condition to a full load condition, the transconductance of the pass transistor 106 increases significantly. Due to this change, the bandwidth of the output buffer circuit 100 undergoes significant expansion that leads to instability of the output buffer circuit 100. By adjusting the loop gain of the output buffer amplifier 104, the bandwidth expansion is significantly reduced, thereby leading to a stable output buffer circuit 100 over all load currents. An exemplary circuit implementation of the output buffer with a load dependent compensation circuit with a servo loop circuit 110 will now be described with reference to FIG. 2.

Figure 2:
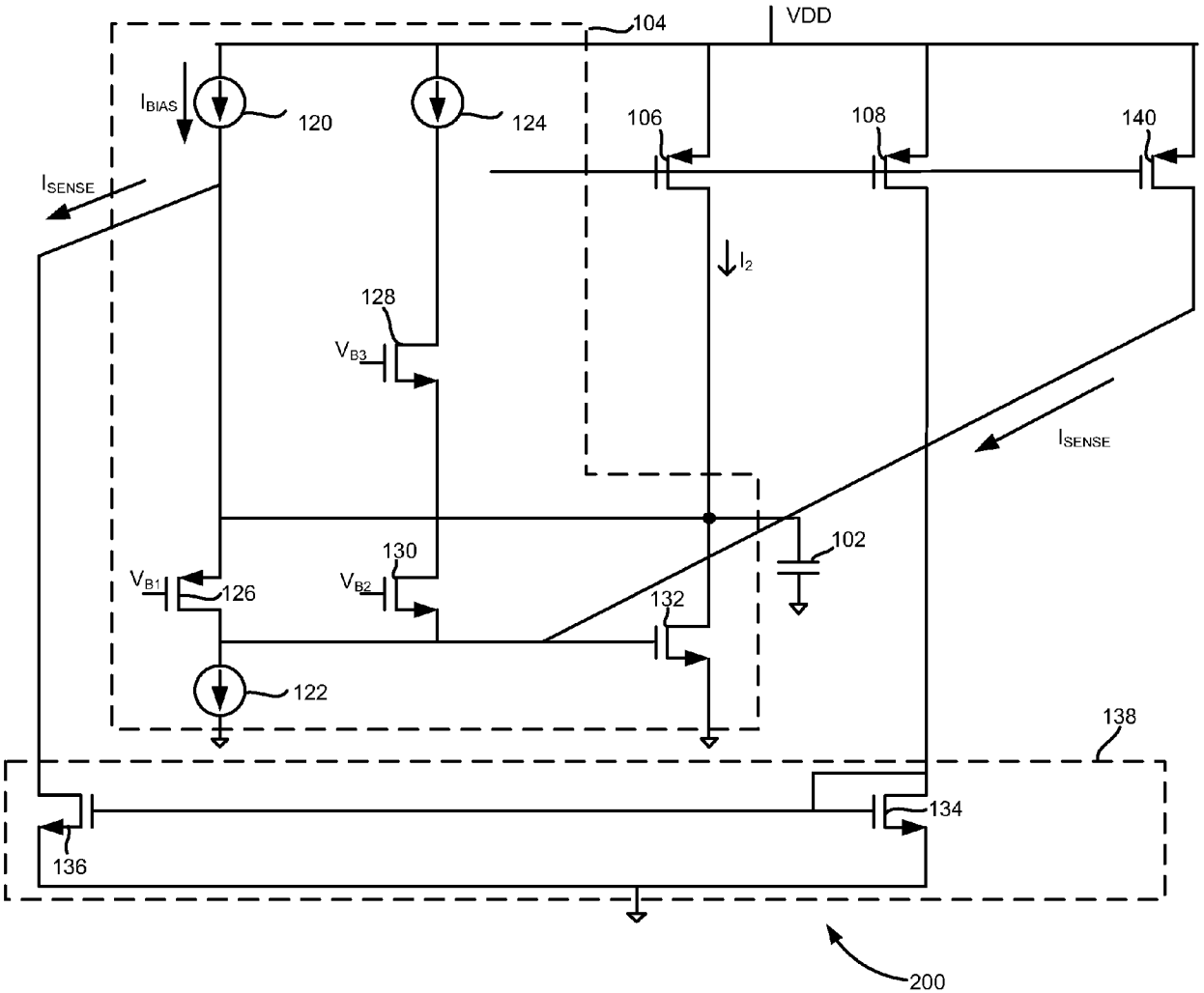
FIG. 2 illustrates an exemplary circuit implementation of the output buffer with a load dependent compensation circuit of FIG. 1, according to one embodiment.

Now referring to FIG. 2, the output buffer amplifier 104 of the output buffer circuit 100 includes a first current source 120, a second current source 122, a third current source 124, a second PMOS transistor 126, a first NMOS transistor 128, a second NMOS transistor 130 and a third NMOS transistor 132. The servo loop circuit 110 includes a second sense transistor 134 and a third sense transistor 136 configured as a current mirror 138 and a fourth sense transistor 140. The construction and operation of the output buffer circuit 100 will now be explained.

The first current source 120 is configured to couple to the supply voltage VDD and the capacitive load 102. The source terminal of the second PMOS transistor 126 is coupled to the capacitive load 102 and the drain terminal of the second PMOS transistor 126 is coupled to the second current source 122. The third current source 124 is configured to couple to the supply voltage VDD and the drain terminal of the first NMOS transistor 128. The source terminal of the first NMOS transistor 128 is configured to couple to the drain terminal of the second NMOS transistor 130. The source terminal of the second NMOS transistor 130 is coupled to the second current source 122. The drain terminal of the third NMOS transistor 132 is coupled to the capacitive load 102. The gate terminal of the third NMOS transistor 132 is coupled to the source terminal of the second NMOS transistor 130. The gate of second PMOS transistor 126 receives a gate bias voltage of VB1. The gate of first NMOS transistor 128 receives a gate bias voltage of VB3 and the gate of second NMOS transistor 130 receives a gate bias voltage of VB2.

In one embodiment, the pass transistor 106 is a PMOS transistor. The source terminal of the pass transistor 106 is coupled to the source voltage VDD and the drain terminal of the pass transistor 106 is coupled to the capacitive load 102. A first sense transistor 108 is coupled to the supply voltage VDD and the gate terminal of the first sense transistor 108 is coupled to the third current source. The current mirror 138 is coupled to the first sense transistor 108 and to the first current source 120. The fourth sense transistor 140 is coupled to the supply voltage VDD and to the source terminal of the second NMOS transistor 130. The first sense transistor 108 and the fourth sense transistor 140 are PMOS transistors. The second sense transistor 134 and the third sense transistor 136 are NMOS transistors.

Now, the operation of the output buffer circuit 100 will be described with reference to FIG. 2. The first sense transistor 108 is configured to sense (or measure) the load current IL delivered to the capacitive load 102. This sense current Isense is mirrored using the current mirror 138 and subtracted from the bias current Ibias for the second PMOS transistor 126. This reduces the transconductance of the second PMOS transistor 126 and thereby reduces the overall bandwidth. In order to maintain the overall biasing for the output buffer circuit, a copy of the sense current Isense is injected at the source of the second NMOS transistor 130. This enables the current flowing through second NMOS transistor to be constant. In one embodiment, the mirror ratio between the pass transistor 106 and the first sense transistor is kept small. During no load conditions, the current through the first sense transistor 108 will be negligible so as not to adversely impact the overall performance. During full load conditions, the current through the first sense transistor 108 increases to ensure bandwidth is reduced, as the sensed current is subtracted from the bias current Ibias for the second PMOS transistor 126.

Figure 3:
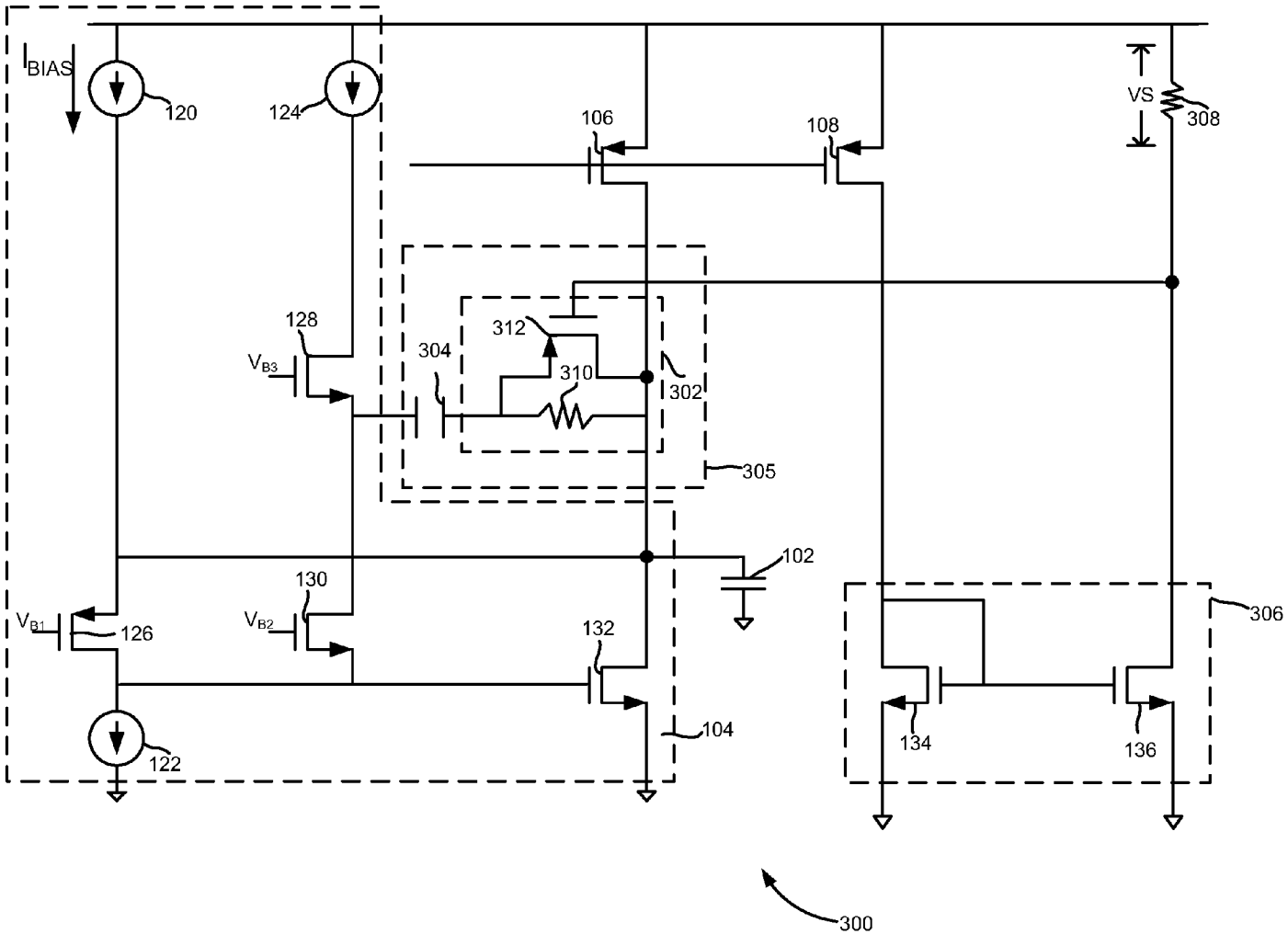
FIG. 3 illustrates a circuit diagram of an output buffer with an alternate load current dependent compensation circuit, according to one embodiment.

FIG. 3 illustrates a circuit diagram of an output buffer 300 with an alternate load current dependent compensation circuit that is coupled to a capacitive load 102. The output buffer circuit 300 includes an output amplifier 104, a pass transistor 106, a first sense transistor 108, a variable resistance circuit 302, a Miller capacitor 304, a second current mirror circuit 306 and a sense resistor 308.

In one embodiment, the structure of the output amplifier 104 is similar to the structure of the output amplifier 104 described with reference to FIG. 2. The Miller capacitor 304 and the variable resistance circuit 302 are connected in series, to form a feedback impedance 305. The variable resistance circuit 302 is coupled to the capacitive load 106. The Miller capacitor 304 is coupled to the drain of the second NMOS transistor 130. The variable resistance circuit 302 includes a second resistor 310 and a fifth transistor 312 coupled in parallel to each other. In one embodiment, the fifth transistor 312 is a PMOS transistor. The source of the fifth transistor 312 is coupled to the Miller capacitor 304 and the drain of the fifth transistor 312 is coupled to the capacitive load 102.

The second current mirror circuit 306 in one embodiment is similar to the current mirror circuit 138 of FIG. 2, with a second sense transistor 134 and the third sense transistor 136. The first sense transistor 108 in one embodiment, is a PMOS transistor and the source of the first sense transistor 108 is coupled to the supply voltage VDD and the drain of the first sense transistor is coupled to the second sense transistor 134. The sense resistor 308 is coupled to the supply voltage VDD and to the third sense transistor 136. The voltage across sense resistor 308 is applied to the gate of fifth transistor 312. The operation of the output buffer 300 will now be described.

The load current IL is sensed by first sense transistor 108. The second sense transistor 134 and the third sense transistor 136 of the second current mirror circuit 306 mirror the sensed load current IL and apply the current across sense resistor 308. The voltage drop across the sense resistor 308 is representative of the load current IL. The voltage across the sense resistor 308, Vs is applied to the gate of the fifth transistor 312. During no load conditions, the sense voltage Vs is high and this high voltage is configured to turn off the fifth transistor 312. Under this condition, the equivalent series resistance of the variable resistance circuit 302 is dominated by the second resistor 310. Under full load conditions, the sense voltage Vs is low and the fifth transistor 312 is turned on and the equivalent series resistance will be dominated by the resistance of the fifth transistor 312.

By properly configuring the fifth transistor 312, the miller zero may be pushed to very high frequencies for full load conditions such that its effect is negligent. Such a scenario is achieved by fifth transistor 312 virtually shorting second resistor 310 during full load condition, thereby the miller zero is determined by the combination of Miller capacitor 304 and fifth transistor 312. Additionally, the value of the second resistor 310 may be selected to be high enough to achieve a good phase margin at intermediate load conditions, without concern about the stability at full load conditions. By selectively varying the effective resistance of the variable resistance circuit 302, an output buffer exhibiting better stability and bandwidth over the wide range of load current can be achieved. As an example, a phase margin of greater than 45 degrees at intermediate load conditions may be achieved by properly selecting second resistor 310.

Figure 4:
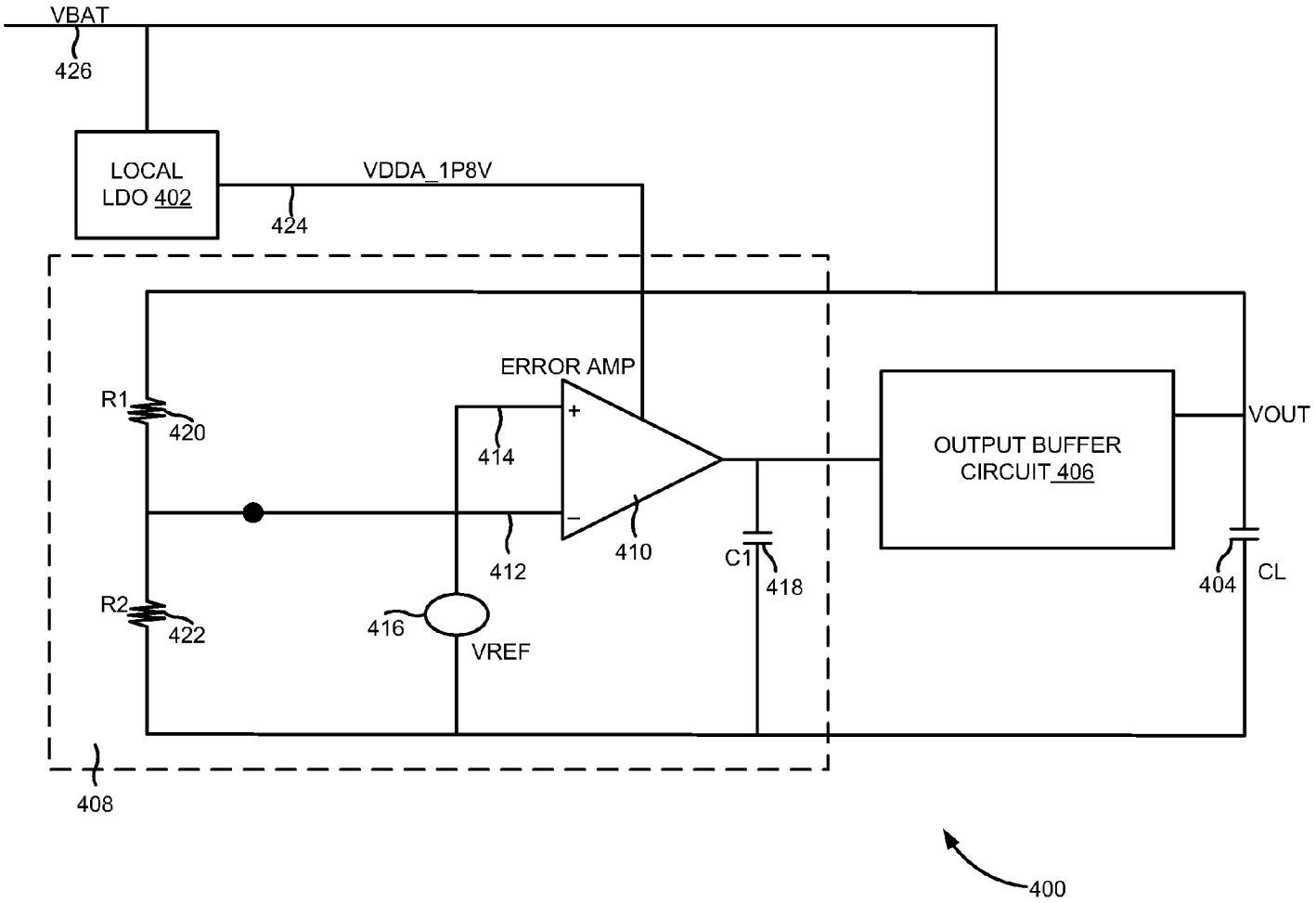
FIG. 4 illustrates an exemplary direct battery connected low drop out voltage regulator coupled to an external capacitive load, with an exemplary output buffer with a load current dependent compensation circuit, according to one embodiment.

Now, referring to FIG. 4, an exemplary voltage regulator circuit 400 with an error amplifier logic 408 coupled to an output buffer circuit 406 that is coupled to an external capacitive load 404 is described. The voltage regulator circuit 400 includes a low dropout regulator 402, an error amplifier logic 408 and an output buffer circuit 406. The output buffer circuit 406 may be constructed as described with reference to FIGS. 1, 2 and 3. The error amplifier logic 408 includes an error amplifier 410 with an inverting input 412 and a non inverting input 414. A reference voltage 416 (VREF) is coupled to the non inverting input 414 of the error amplifier logic 408. The output of the error amplifier 408 is coupled to a storage capacitor 418 and the input of the output buffer circuit 406. The output of the output buffer circuit is coupled to the capacitive load 404. In one embodiment, the capacitive load 404 may be a battery. The output of the output buffer circuit 406 is fed back to a resistor bridge with a first bridge resistor 420 and a second bridge resistor 422. The voltage across the second bridge resistor 422 is coupled to the inverting input 412 of the error amplifier 410. An output 424 of the low dropout regulator 402 is coupled to the error amplifier 410, to supply a voltage to the error amplifier 410. A source voltage 426 (VBAT) is supplied as a supply voltage to the low dropout regulator 402 and the output buffer circuit 406.

Figure 5:
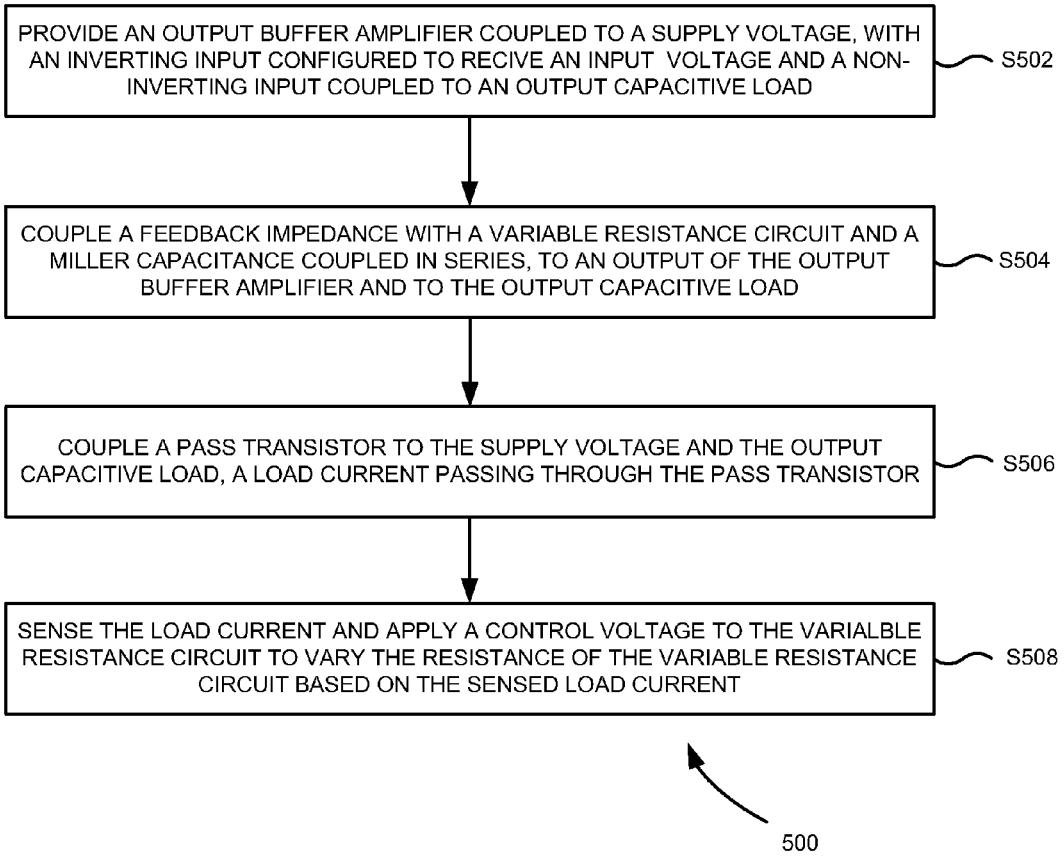
FIG. 5 illustrates a process flow chart of an exemplary method for load compensating in an output buffer circuit, according to one embodiment.

FIG. 5 illustrates a process flow chart of an exemplary method 500 for load compensating in an output buffer circuit, according to one embodiment. In operation S502, an output buffer amplifier coupled to a supply voltage, with an inverting input configured to receive an input voltage and a non-inverting input coupled to an output capacitive load is provided. For example, referring to FIG. 3, an exemplary output buffer amplifier 104 and a capacitive load 102 is described.

In operation S504, a feedback impedance with a variable resistance circuit and a Miller capacitance coupled in series is coupled to an output of the output buffer amplifier and to the output capacitive load. For example, referring to FIG. 3, an exemplary feedback impedance 305 is provided, with a Miller capacitor 304 and the variable resistance circuit 302 coupled in series. The feedback impedance 305 is coupled to an output of the output buffer amplifier 104 and to the output capacitive load 102.

In operation S506, a pass transistor is coupled to the supply voltage and the output capacitive load, with a load current passing through the pass transistor. For example, referring to FIG. 3, the pass transistor 106 is coupled to the supply voltage and the capacitive load 102.

In operation S508, the load current is sensed and a control voltage is applied to the variable resistance circuit to vary the resistance of the variable resistance circuit based on the sensed load current. For example, referring to FIG. 3, the load current IL is sensed by first sense transistor 108. The second sense transistor 134 and the third sense transistor 136 of the second current mirror circuit 306 mirror the sensed load current IL and apply the current across sense resistor 308. The voltage drop across the sense resistor 308 is a control voltage representative of the load current IL. The voltage across the sense resistor 308, Vs (control voltage) is applied to the gate of the fifth transistor 312, which is part of the variable resistance circuit. The variable resistance circuit 302 includes the fifth transistor 312 coupled in parallel with the second resistor 310. During no load conditions, the sense voltage Vs is high and this high voltage is configured to turn off the fifth transistor 312. Under this condition, the equivalent series resistance of the variable resistance circuit 302 dominated by the second resistor 310. Under full load conditions, the sense voltage Vs is low and the fifth transistor 312 is turned on and the equivalent series resistance will be dominated by the resistance of the fifth transistor 312.

Figure 6:
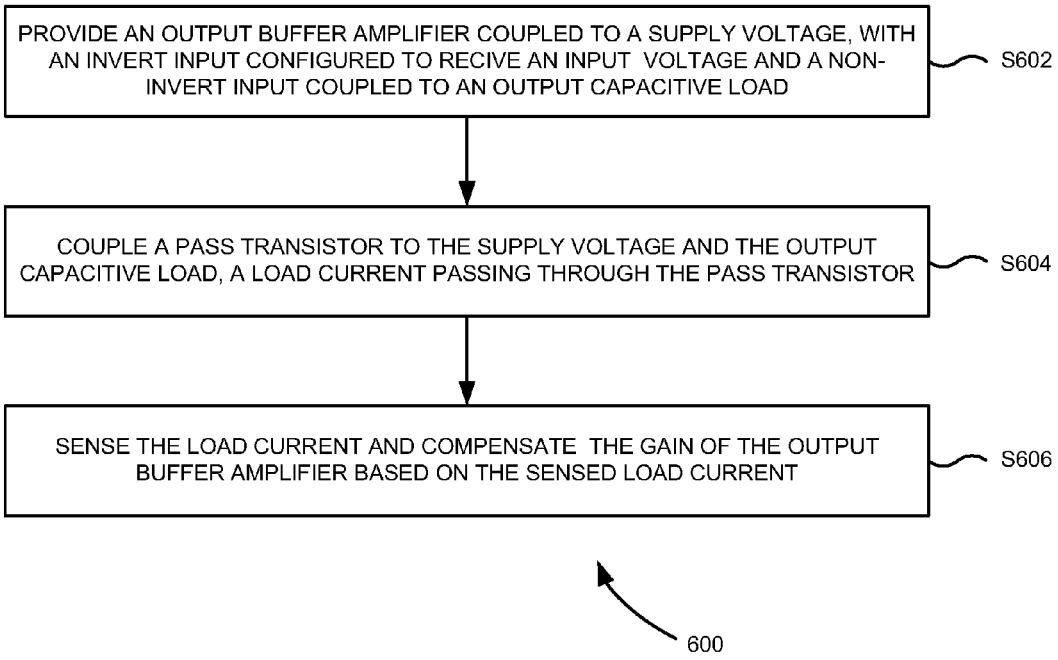
FIG. 6 illustrates another process flow chart of an exemplary method 600 for compensating load current in an output buffer circuit, according to one embodiment.

FIG. 6 illustrates a process flow chart of an exemplary method 600 for compensating load current in an output buffer circuit. In operation S602, an output buffer amplifier coupled to a supply voltage, with an inverting input configured to receive an input voltage and a non-inverting input coupled to an output capacitive load is provided. For example, referring to FIG. 2, an exemplary output buffer amplifier 104 and a capacitive load 102 is described.

In operation S604, a pass transistor is coupled to the supply voltage and the output capacitive load, with a load current passing through the pass transistor. For example, referring to FIG. 2, the pass transistor 106 is coupled to the supply voltage and the capacitive load 102.

In operation S606, the load current is sensed and the gain of the output buffer amplifier is compensated, based on the sensed load current. For example, referring to FIG. 2, the first sense transistor 108 is configured to sense (or measure) the load current IL delivered to the capacitive load 102. This sense current Isense is mirrored using the current mirror circuit 138 and subtracted from the bias current Ibias for the second PMOS transistor 126. This reduces the transconductance of the second PMOS transistor 126 and thereby reduces the overall bandwidth. In order to maintain the overall biasing for the output buffer circuit, a copy of the sense current Isense is injected at the source of the second NMOS transistor 130. This enables the current flowing through second NMOS transistor to be constant. In one embodiment, the mirror ratio between the pass transistor 106 and the first sense transistor is kept small. During no load conditions, the current through the first sense transistor 108 will be negligible so as not to adversely impact the overall performance. During full load conditions, the current through the first sense transistor 108 increases to ensure bandwidth is reduced, as the sensed current is subtracted from the bias current Ibias for the second PMOS transistor 106.

The various devices, modules, analyzers, generators, etc. described herein may be enabled and operated using hardware circuitry (e.g., complementary metal-oxide-semiconductor (CMOS) based logic circuitry), firmware, software and/or any combination of hardware, firmware, and/or software (e.g., embodied in a machine readable medium). Further, the various electrical structure and methods may be embodied using transistors, logic gates, and/or electrical circuits (e.g., application specific integrated circuit (ASIC)). Although the present embodiments have been described with reference to specific example embodiments, it will be evident that various modifications and changes may be made to these embodiments without departing from the broader spirit and scope of the various embodiments. For example, the present embodiments are discussed in terms of an output buffer for a low dropout voltage regulator. However, the present embodiments can be applied to various systems employing negative feedback requiring compensation.

What is claimed is:

1. A load current compensating output buffer circuit, comprising:

an output buffer amplifier with a terminal for coupling to a supply voltage and having an inverting input and a non-inverting input, the inverting input being configured to receive an input voltage and the non-inverting input is coupled to an output capacitive load;

a feedback impedance coupled to an output of the output buffer amplifier and to the output capacitive load, the feedback impedance includes a variable resistance circuit and a Miller capacitance coupled in series;

a pass transistor configured to couple to the supply voltage and the output capacitive load, the pass transistor having a gate terminal coupled to the output of the output buffer amplifier and the feedback impedance, a load current passing through the pass transistor; and a sense circuit configured to sense the load current and apply a control voltage to the variable resistance circuit to vary the resistance of the variable resistance circuit based on the load current;

the output buffer amplifier including:

a first current source for coupling to the supply voltage and the output capacitive load;

a second PMOS transistor having a source terminal coupled to the output capacitive load and a drain terminal coupled to a second current source:

a third current source for coupling to the supply voltage and a drain terminal of a first NMOS transistor, a source terminal of the first NMOS transistor being coupled to the feedback impedance;

a second NMOS transistor having a drain terminal coupled to the source terminal of the first NMOS transistor and the feedback impedance, the source terminal being coupled to the second current source; and a third NMOS transistor having a drain terminal coupled to the output capacitive load and a gate terminal coupled to the source terminal of the second NMOS transistor.

2. The output buffer circuit of claim 1, in which the pass transistor includes a first PMOS transistor with a source terminal for coupling to the supply voltage and a drain terminal coupled to the output capacitive load.

3. The output buffer circuit of claim 1, in which the sense circuit includes:

a first sense transistor for coupling to the supply voltage and having a gate terminal coupled to the third current source;

a current mirror coupled to the first sense transistor including a second sense transistor and a third sense transistor;

a sense resistor for coupling to the supply voltage and the current mirror; and a voltage across the sense resistor applied as the control voltage to the variable resistor circuit.

4. The output buffer circuit of claim 3, in which the variable resistor circuit includes a second resistor and a fifth transistor coupled in parallel, in which the gate terminal of the fifth transistor receives the control voltage.

5. The output buffer circuit of claim 4, in which the fifth transistor is substantially maintained in a high impedance state by the applied control voltage, when the load current is substantially in a no load or low load condition.

6. The output buffer circuit of claim 4, in which the fifth transistor is substantially maintained in a low impedance state by the applied control voltage, when the load current is substantially in a high load condition.

7. The output buffer circuit of claim 4, in which the fifth transistor transitions from a high impedance state to a low impedance state as the load current changes from a substantially no load condition to a high load condition.

8. The output buffer circuit of claim 4, in which the first sense transistor includes a PMOS transistor, the second and third sense transistors include NMOS transistors, and the fifth transistor includes a PMOS transistor.

* * * * *